United States Patent [19]

Shaw

[11] 3,998,072

[45] Dec. 21, 1976

[54] PORTABLE WINE COOLER

[75] Inventor: Howard G. Shaw, Ross, Calif.

[73] Assignee: Shaw-Clayton Plastics, Inc., San Rafael, Calif.

[22] Filed: Mar. 12, 1975

[21] Appl. No.: 557,825

[52] U.S. Cl. ..... 62/457; 62/372; 62/530

[51] Int. Cl.[2] ..... F25D 3/08

[58] Field of Search ..... 62/457, 530, 372

[56] References Cited

UNITED STATES PATENTS

| | | | |
|---|---|---|---|
| 2,564,165 | 8/1951 | Magis | 62/457 |
| 2,730,151 | 1/1956 | Smith | 62/457 |
| 2,979,227 | 4/1961 | Norton et al. | 62/457 |
| 3,006,165 | 10/1961 | Mittelberger | 62/457 |
| 3,365,911 | 1/1968 | Stoner et al. | 62/457 |
| 3,387,650 | 6/1968 | Hoffmann et al. | 62/457 |
| 3,434,302 | 3/1969 | Stoner et al. | 62/457 |
| 3,614,875 | 10/1971 | McCallun | 62/457 |

*Primary Examiner*—Lloyd L. King
*Attorney, Agent, or Firm*—Flehr, Hohbach, Test, Albritton & Herbert

[57] ABSTRACT

Portable cooler for keeping chilled a bottle of wine or the like comprising a carrying case in which a plurality of flasks of coolant are removably disposed about the bottle. In one embodiment, the carrying case is fabricated of a flexible material which is drawn together at the top and removably secured about the neck of the bottle.

8 Claims, 5 Drawing Figures

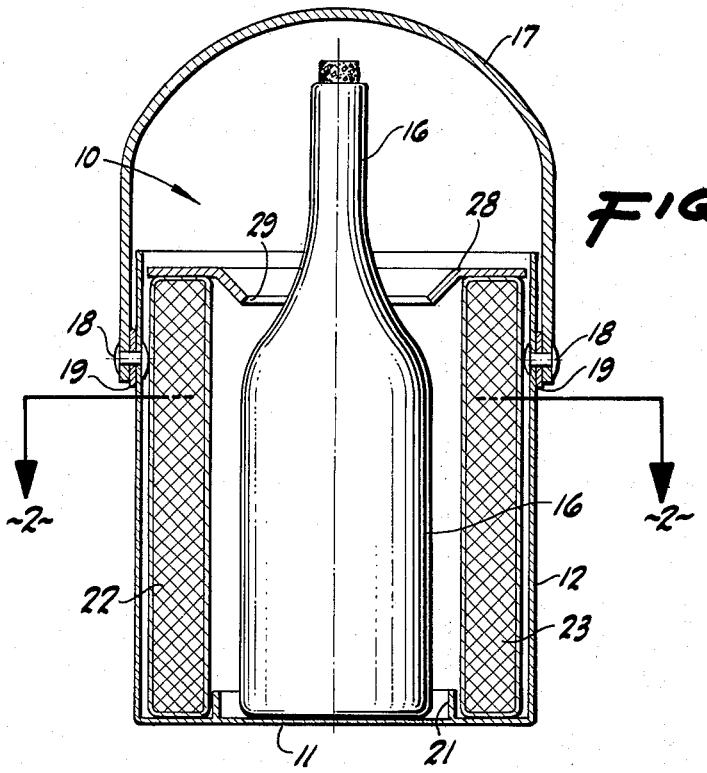
FIG-1
FIG-3
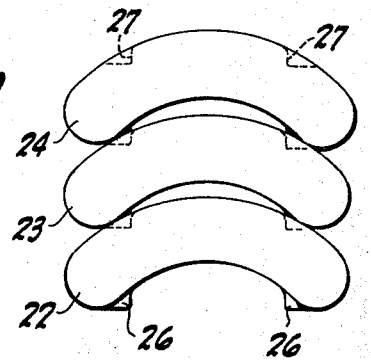
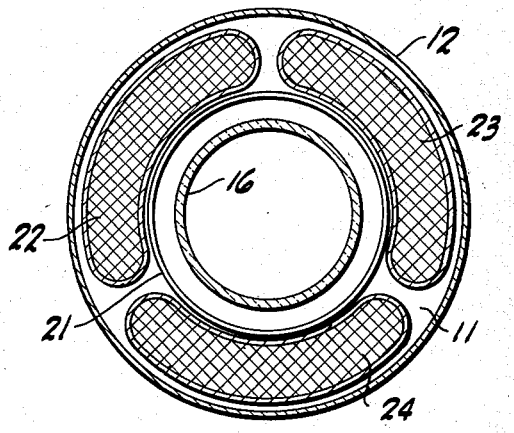
FIG-2
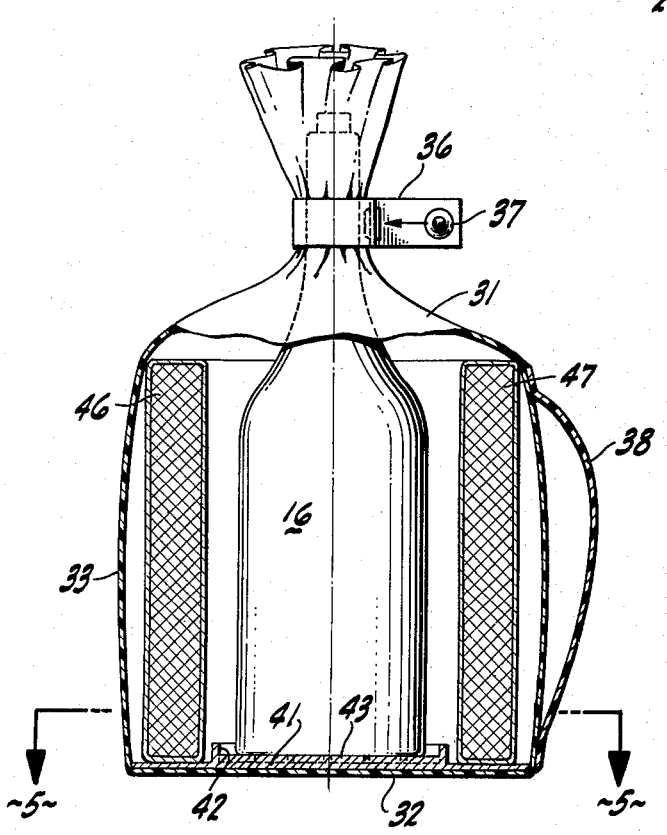
FIG-4
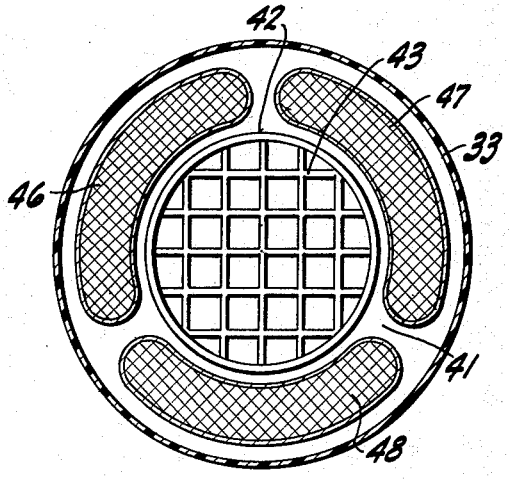
FIG-5

PORTABLE WINE COOLER

SUMMARY AND OBJECTS OF THE INVENTION

This invention pertains generally to cooling apparatus and more particularly to a portable cooler for keeping chilled a bottle of wine or the like.

The cooler comprises a carrying case in which a plurality of flasks of coolant are removably disposed about the bottle to be kept cool. In one embodiment, the carrying case is fabricated of a flexible material which is drawn together at the top and removably secured about the neck of the bottle.

It is in general an object of the invention to provide a portable cooler for keeping chilled a bottle of wine or the like.

Another object of the invention is to provide a portable cooler of the above character utilizing flasks of coolant removably disposed about the bottle to be kept cool.

Additional objects and features of the invention will be apparent from the foregoing description in which the preferred embodiments are set forth in detail in conjunction with the accompanying drawings.

BRIEF DESCRIPTION OF THE DRAWINGS

FIG. 1 is a center-line sectional view of one embodiment of a portable cooler according to the invention.

FIG. 2 is a cross sectional view taken along line 2—2 in FIG. 1.

FIG. 3 illustrates the manner in which the coolant flasks can be stacked when removed from the cooler.

FIG. 4 is a center-line sectional view of another embodiment of a portable cooler according to the invention.

FIG. 5 is a cross sectional view taken along line 5—5 of FIG. 4.

DESCRIPTION OF THE PREFERRED EMBODIMENTS

As illustrated in FIGS. 1 and 2, the portable cooler comprises a carrying case 10 having a bottom wall 11 and a generally cylindrical side wall 12. The case is of a suitable size to accommodate a bottle 16 to be kept cool, such as a bottle of wine or the like. A handle 17 by which the cooler can be lifted and carried is pivotally attached to the side wall of the case by suitable means such as rivets 18 and spacers 19. In this embodiment, the carrying case and handle are fabricated of a thermally insulative rigid material such as plastic.

A retaining ring consisting of an upstanding annular flange 21 of larger diameter than the bottle is disposed coaxially of bottom wall 11. In this embodiment, the retaining ring is formed as an integral part of the bottom wall, but it can be a separate element, if desired.

A plurality of flasks of coolant 22–24 are removably disposed in the case and spaced peripherally to form a centrally disposed chamber for receiving bottle 16 in an upright position. Each of the flasks comprises a body of suitable coolant such as a gel enclosed in a sealed container. A preferred gel is disclosed in U.S. Pat. No. 3,130,163. As illustrated, the flasks are axially elongated and arcutely curved to conform to the contour of the bottle and side wall of the carrying case. The flasks are fabricated of a rigid material such as plastic, and they retain their curved contour when warm or cold. In the embodiment illustrated, three flasks are provided, and each has an arc length slightly less than 120°. The flasks are formed to include lugs 26 which extend in an inward radial direction and recesses 27 which face outwardly and are adapted to receive the lugs of other flasks when the flasks are removed from the cooler and stacked in the manner illustrated in FIG. 3.

The lower positions of flasks 22–24 rest between retaining ring 21 and side wall 12. The upper portions of the flasks are held in position by a removable retaining ring or cap 28 which engages the upper portions of the flasks and maintains them a predetermined distance from the center of the case. Cap 28 has a central opening 29 of larger diameter than bottle 16 to permit insertion and removal of the bottle with the retaining cap in place.

Operation and use of the cooler of FIGS. 1 and 2 can be described briefly. Flasks 22–24 are removed from the carrying case and placed in a freezer to freeze the coolant. After freezing, the flasks are placed in the carrying case, and retaining ring or cap 28 is positioned on top of them. The bottle is then inserted into the chamber formed by the flasks. For pouring, the bottle can be removed from the cooler through opening 29 in retaining ring 28 without disturbing either this ring or the flasks.

In the embodiment of FIG. 3, the carrying case comprises a pouch 31 of flexible material such as a suitable fabric or vinyl plastic. The pouch includes a bottom wall 32 and a side wall 33, and the upper portion of the pouch is drawn together about the neck of bottle 16 and secured thereto by a strap 36 provided with a snap 37 or other suitable fastener. A handle 38 for lifting and carrying the cooler is affixed to side wall 33 by suitable means such as sewing or heat sealing.

A base 41 fabricated of a semi-rigid material such as vinyl plastic is provided adjacent to the bottom wall of the pouch and, if desired, can be affixed thereto. The base includes an annular flange 42 disposed coaxially of the case and a gridwork 43 disposed coaxially of the flange for receiving the bottom of the bottle and supporting the bottle in an upright position. Coolant flasks 46–48 similar to flasks 22–24 are removably disposed about the periphery of the pouch, and the lower portions of these flasks rest between flanges 42 and side wall 33.

In use, flasks 46–48 are removed from the pouch and placed in a suitable freezer to freeze the coolant. After freezing, the flasks are replaced in the pouch, and the bottle is placed in an upright position on gridwork 43 in the central chamber formed by the flasks. The upper portion of the pouch is drawn about the neck of the bottle and secured by strap 36 and snap 37. In this embodiment, it is not necessary to remove the bottle from the pouch for pouring. Gridwork 43 provides thermal insulation and cushioning for the bottom of the bottle.

It is apparent that a new and improved cooler has been provided. While only two preferred embodiments have been described, as will be apparent to those familiar with the art, certain changes and modifications can be made without departing from the scope of the invention as defined by the following claims.

I claim:

1. A portable cooler for keeping a bottle of wine or the like chilled, comprising: a carrying case having a bottom wall and a generally cylindrical side wall, a lower retaining ring comprising an upwardly extending annular flange of greater diameter than the bottle disposed coaxially of the bottom wall and adjacent thereto, a plurality of axially extending flasks of coolant removably disposed in the case and spaced peripherally thereof to form a centrally disposed chamber for receiving the bottle in an upright position, the lower portions of the flasks resting between the flange and the side wall of the case, and a removable retaining ring for engaging the upper portions of the coolant flasks and holding the same a predetermined distance from the center of the case.

2. The portable cooler of claim 1 wherein each of the flasks comprises a rigid container formed with a curvature corresponding to the curvature of the bottle.

3. The portable cooler of claim 2 wherein each of the flasks has an arcuate curvature and an arc length on the order of 120°.

4. The portable cooler of claim 1 wherein the case includes a handle by which the cooler can be lifted and carried.

5. The portable cooler of claim 1 wherein the lower retaining ring is formed integrally with the bottom wall of the carrying case.

6. The portable cooler of claim 1 further including means for engaging the upper portion of the bottle and holding the same in a predetermined position.

7. The portable cooler of claim 1 wherein the carrying case comprises a pouch of flexible material drawn together toward the top and removably secured about the neck of the bottle.

8. The portable cooler of claim 1 further including a supporting gridwork disposed within the flange for receiving the bottom of the bottle therein.

* * * * *